US005595456A

United States Patent [19]

Berg et al.

[11] Patent Number: 5,595,456

[45] Date of Patent: Jan. 21, 1997

[54] WATER-TIGHT RISER FOR UNDERGROUND STORAGE TANK MANWAY

[75] Inventors: Robin Berg, Hudson, Wis.; Mark Baumgartner, Farmington, Minn.

[73] Assignee: Xerxes Corporation, Minneapolis, Minn.

[21] Appl. No.: 437,787

[22] Filed: May 9, 1995

[51] Int. Cl.[6] ..... B65G 5/00

[52] U.S. Cl. ..... 405/53; 405/54

[58] Field of Search ..... 405/53, 52, 54, 405/55, 128

[56] References Cited

U.S. PATENT DOCUMENTS

| | | | |
|---|---|---|---|
| 4,884,709 | 12/1989 | McCarthy | 405/53 X |
| 4,936,705 | 6/1990 | Schneider | 405/54 |
| 4,958,957 | 9/1990 | Berg et al. | 405/53 X |
| 5,060,509 | 10/1991 | Webb | 405/54 X |
| 5,122,264 | 6/1992 | Mohr et al. | 405/53 X |
| 5,244,307 | 9/1993 | Wokas | 405/53 |

*Primary Examiner*—Stephen J. Novosad

*Attorney, Agent, or Firm*—Oblon, Spivak, McClelland, Maier & Neustadt, P.C.

[57] ABSTRACT

An underground storage tank provided with a manway is equipped with a riser extending from the storage tank, about the manway, to a point just below the access way provided in the ground level of the installation. The riser is provided with a water-tight cover which is released through operation of a cam. The water-tight riser excludes water from the interior of the riser and the manway, ensuring access to the manway, operation of the fittings provided in the manway, an additional containment of fluid passing through the manway and the area of the tank adjacent thereto. Because it is water-tight, an alarm sensitive to liquid may be placed in the interior of the riser to alert the operator to the possible loss of containment, or loss of water-tight sealing between the cover and the riser.

8 Claims, 3 Drawing Sheets

WATER-TIGHT RISER FOR UNDERGROUND STORAGE TANK MANWAY

BACKGROUND OF THE INVENTION

1. Field of the Invention

This invention pertains to improved underground storage tanks principally designed for storage of liquid materials, such as petroleum-based fuels, chemicals and other liquid resources. Specifically, a water-tight riser is provided about a manway, for providing access to the interior of the tank, while maintaining the manway, the riser, an alarm device as provided as well as piping, free of water, drainage, and other liquids that might otherwise accumulate therein.

2. Bacckground of the Prior Art

The use of underground storage tanks for the containment of fluids, such as petroleum fuels and the like, is well known. A typical gasoline service station installation comprises one or more underground storage tanks which can be accessed through a removable plate in the apron of the facility, to fill and remove gasoline. Typically, an underground storage tank is provided with a manway, if large enough to require access to the interior, through which manway a variety of fixtures, such as a filling device, a submersible pump, and other fixtures as required, are provided. While the fixtures generally penetrate through the manway lid, the manway itself may be provided with a removable lid to access the interior of the tank. While other types of underground storage tanks abound and are within the scope of the invention of this application, such as cryogenic tanks and the like, the dominant form of underground storage tank is for the storage of petroleum fuels such as gasoline, diesel fuel and the like.

The initial use of underground storage tanks included the preparation of steel tanks, or tanks of various other metal alloys. Steel, being relatively light weight and sufficiently strong to withstand applied pressures, provide sure resistance and the like, provided a building material which could be easily worked with. Examples of such tanks abound in the literature, and steel tanks are made today for such purposes. One example of early literature directed to steel tanks is U.S. Pat. No. 1,886,074. Steel and other metal alloys are subject to rust and corrosion. Even in a "dry hole," that is an installation provided in the ground which does, not fill with water, rain water, ground water and additional sources of moisture such as runoff and the like, will accumulate and the tank is exposed, both from the inside and the outside, to potential corrosion sources. In the worst case, the hole in which the tank is installed may fill, either due to altered surface circumstances like flooding, leading to an accumulation of water in the hole, or commonly, due to a high water table. Under these circumstances, highly corrosive brine, may be present also in the hole, as is commonly encountered in coastal sites. Corrosion of the tanks can lead to spot holing, as well as weakened strength, buckling and the like. Whether due to holing or a structural collapse, escape of the contained materials from the confines of the tank due to a failure pose severe environmental hazards. Cleanup of released fuel from a failed tank poses severe time and monetary considerations.

To overcome the tendency of steel to rust and corrode, reinforced plastic tanks have been adopted. Specifically, fiberglass reinforced resin tanks have been used, fiberglass tanks being resistant to corrosion and rusting. The resinous material used as the matrix is selected from a variety of materials, specifically desired to be resistant to penetration by, or adsorption of, the fuels or liquids to be contained, including methanol, ethanol as well as more familiar fuels such as gasoline and the like. A wide variety of resins may be employed in a single tank, including a highly specialized coating (such as a vinyl ester resin) to ensure that the contained material cannot pass into the body of the tank, which may be of a more conventional resin. The fiberglass tanks may be molded off of male forms or female forms. Female molding in general gives a more "robust" tank.

Persistent concerns over potential environmental hazards have lead to the adoption of "double-walled tanks," in which the tank containing the fluid material is provided with a surrounding wall, or second wall, such that in the event the interior wall fails, the exterior wall will contain the fluid and avoid release to the environment until repairs can be effected. In the annulus between the inner and outer walls alarm devices of a variety of designs are provided, so as to detect the passage of liquid from the interior tank, or through the exterior tank, into the annulus. In a "dry annulus," detection of the presence of liquid due to changes in sensed electrical conditions are frequently used. A "filled" annulus tank may use an alarm device which senses a change in the fluid level of the annulus, which will occur upon failure of either the inner or the outer tank. In yet a third alternative, the annulus may be slightly pressurized either positively or negatively, such that a leak causes a drop in pressure which may be detected.

In conjunction with such double-walled tanks, it may be customary to provide double-walled piping from the pump, filling means and the like, or in the case of a single network, such as that described in U.S. Pat. No. 4,958,957, piping in and between various tanks. In such a system, the contained liquid is dually contained throughout the system.

In order to access the tank to fill it, to pump fluid out of the tank, to repair the tank and the like, a manway is generally provided into the tank. A releasable cover provided over the manway contains fittings which pass through, and thereby provide a means to pass liquid into and out of the tank. If the tank needs service, and is of a suitable dimension to accommodate a worker, the cover of the manway itself can be removed, to provide access to the interior.

Tanks are generally buried to a standard depth underground. Principal manufacturers of underground storage tanks provide precise instructions as to the depth, size and character of the hole or opening in which the tank will be set. To access the manway from the surface or apron of the installation, it is necessary to have a clear space or column from the manway to the surface. This is provided through a tubular means rising from the surface of the underground storage tank to a point just below the access provided in the ground level of the facility. This device is called a riser.

Frequently piping accessing the manway will go through the riser to the manway. In order to fill the tank, the manway is accessed by opening the cover in the ground level, accessing the manway through the riser, and providing the necessary liquid material. To ensure dual containment of the fluid wherever it passes, the manway itself may be duly contained by the riser. Such a system is described in U.S. Pat. No. 4,958,957. Where the riser is intended as the secondary containment, an alarm means is frequently provided in the riser, to detect the accumulation of liquid therein. For the reasons discussed above, the riser is generally constructed of fiberglass reinforced plastic material, and adhered to the outer wall of the tank, if double walled, by application of resinous material thereto. The riser may be put in place in situ, or provided on the tank.

Recent, repeated severe flooding of many parts of the country has resulted in numerous underground storage tanks where the water level has risen over the top of the riser (indeed, above preexisting ground level) for an extended period of time. Under these circumstances, the cover of the riser, which must be removable to provide access, is lifted by the water and accumulated liquids pour into the riser, frustrating alarm systems, impeding access to the manway, and providing a potential threat to the integrity of dual containment in a double-walled system.

Accordingly, it remains an object of the industry to provide an underground storage tank installation with a riser which provides access to a manway, which riser can be made water-tight and resistant to the penetration of water into the interior of the riser. At the same time, such a water-tight riser must provide easy access to the manway, and if necessary, the interior of the tank.

SUMMARY OF THE INVENTION

The above objects, and other objects made clear below, are achieved by providing a fiberglass plastic riser about a manway, which riser is structurally adhered to the outer surface of an underground storage tank on which said manway is affixed, such riser being provided with a water-tight cap proximal to an access way provided in the apron or ground level of the facility in which the underground tank is installed. The underground storage tank may be single walled or double walled, steel or metal alloy or fiberglass or a blend of materials. The riser, which may include openings for piping and other fittings to pass through, is provided, at the top adjacent ground level, with a flange which supports a rubber gasket. On the gasket rests a thermoplastic or thermoset fiberglass reinforced plastic dome of slight curvature, the dome edge and flange being forced into abutment, through the gasket by a "C"-shaped clamp circling the edge of the dome and flange. The clamp is releasable by a side motion cam or spring arm, in a fashion similar to a clamp provided about an oil barrel or similar conventional barrel design. In an alternative embodiment, the clamp is secured by tightening a nut on a bolt which passes thought the ends of the resilient clamps. The dome is thus conveniently and easily released for access to the manway, for filling the tank, or otherwise servicing the tank. At the same time, the clamp is easily closed, sealing the cap against the riser flange, and excluding water and other liquid materials from the interior of the riser. This ensures the integrity of the underground tank, and permits the use of alarm systems to detect penetration of the riser, or a leak in the manway, by use of a "dry" alarm.

DETAILED DESCRIPTION OF THE INVENTION

Figure 2:
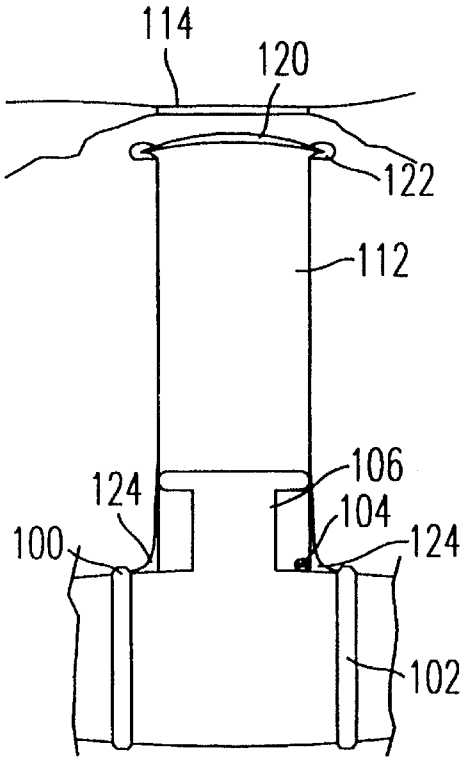
FIG. 2 is an enhanced view of the manway and riser provided thereabout, with an alarm means indicated in the riser.
Figure 1:
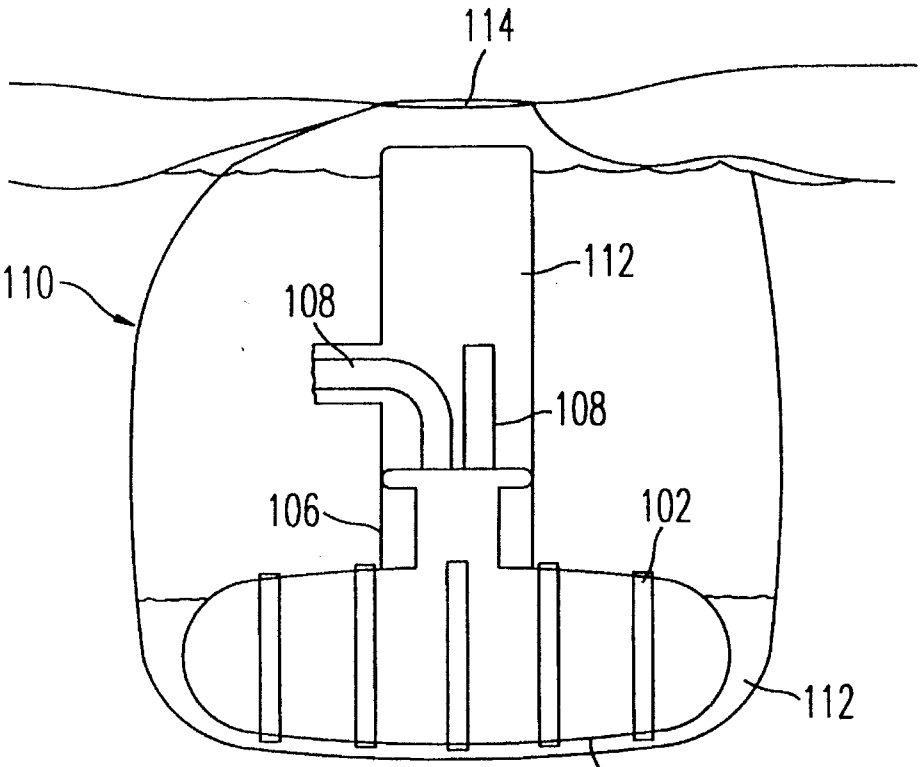
FIG. 1 is a schematic view of an installed underground storage tank provided with a manway and a riser thereabout, with piping passing through the riser. The hole or installation is indicated to be filled with water.

The invention of this application provides a water-tight riser around the manway of an underground storage tank. The underground storage tank 100 is generally installed in a hole or pit 110. In a typical installation, backfill, 112, will be provided about the tank to ensure that the tank is fixed in position. It should be noted that no attempt has been made in this application to accurately reflect either the angle or character of the hole necessary for installation, or proper installation of the backfill. The tank 100 and hole 110 are known, per se, and do not constitute an aspect of this invention.

A typical tank 100 is prepared from fiberglass reinforced plastic, is double walled, the exterior wall being provided with circular reinforcement or "hoop" ribs 102. The tank may be double walled and provided with an annular material which permits liquid flow, while improving the strength and character of the tank as disclosed in U.S. Pat. No. 5,220,823, which is incorporated herein by reference. Tank 100 is provided with manway 106 which includes a lid which carries piping, including piping 108, and other fittings for penetration to the interior of the tank. Riser 112 is affixed to the exterior surface of the tank, at its "top" as installed, encircles manway 106 and rises to a level just below the opening in the ground level of the facility 114, for access to the riser and thereby to the manway. As illustrated, the hole is "wet", giving a water line just below the top of the riser, for ease of illustration.

It is important to note that this invention is useful in connection with either single-walled or double-walled tanks. Additionally, while the tank, manway and riser are preferably made of fiberglass reinforced plastic, as is the dome or cover for the riser, other materials, including metal, thermoplastics, and similar structural may be employed.

As illustrated in FIG. 2, riser 112 extends from tank 100, to which it is affixed by means of application of layers of fiberglass reinforced plastic at the junction 124, rising upwardly to a level just below the opening in the ground level 114, when installed. Installed in the riser, at or about the surface of the tank, is alarm means 104. As the riser is provided with a watertight cap, the presence of liquid in the riser will indicate a failure of the riser itself, the manway or the limited portion of tank 100, in terms of containment. As illustrated in FIG. 2, riser 112 may be conveniently shaped so as to be emplaced between two reinforcing ribs 102 abutting the sides of those ribs, which may be trapezoidal in nature as is conventional in the art.

Riser 112 is generally tubular in shape but, is not limited to that shape, and must be of a circumference to easily accommodate the manway within its interior. A typical riser is 42 inches, or, slightly longer, four feet in diameter although size is not a critical parameter. At the top of the riser, a dome or cap 120 is provided. For strength purposes, the cap is slightly convex, the cap also being preferably constructed of fiberglass reinforced plastic or high density polyethylene. The cap is accessed through access way 114, which is provided in the facility at ground level. As illustrated in FIG. 2, in general, a shroud or other shaped retention area is provided about the manway which continues into the excavation made to accommodate the tank.

Figure 3:
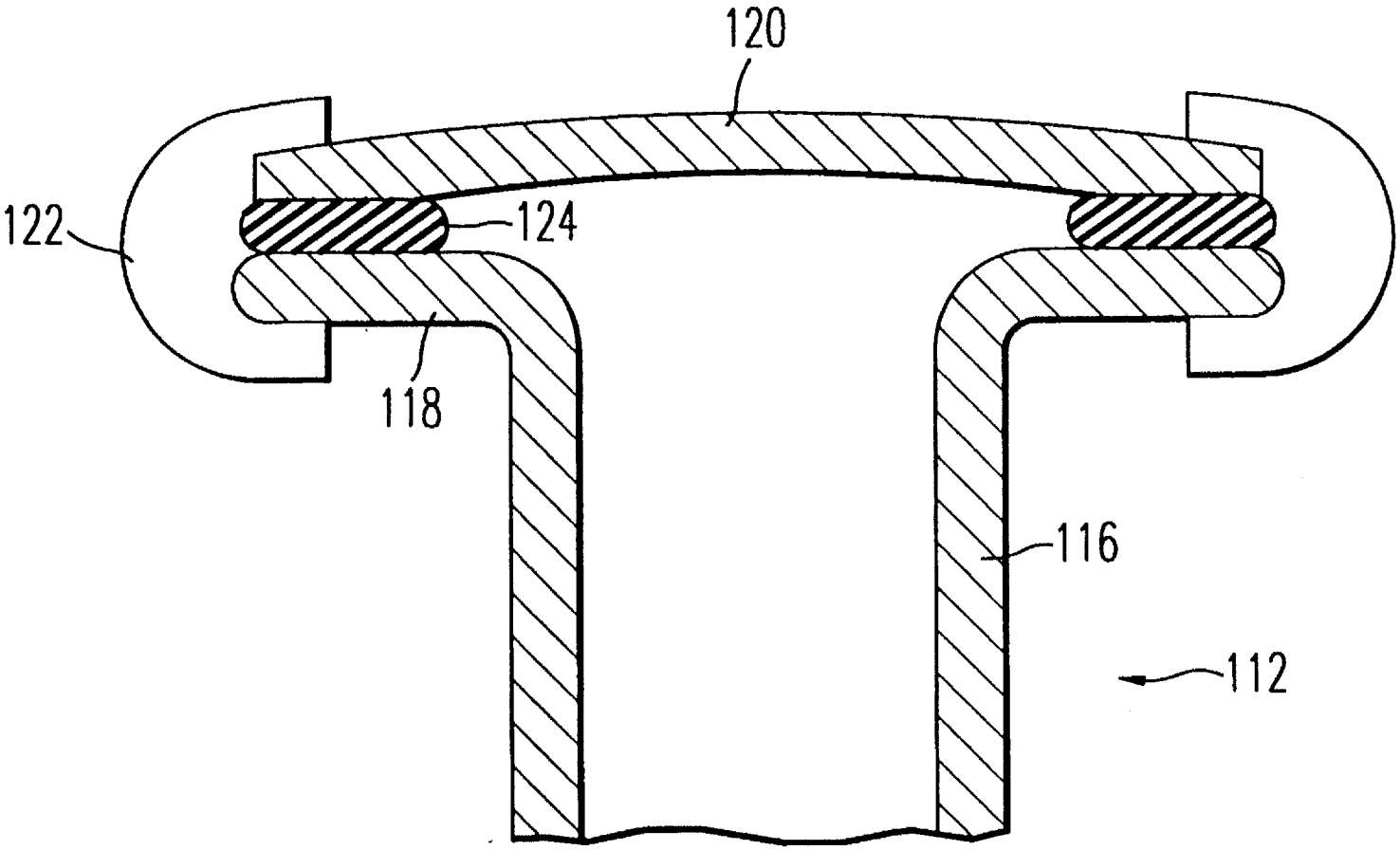
FIG. 3 is an enlarged view of the top of the riser, including the riser flange, a gasket and cap or dome-like curvature. A "C"-clamp is provided thereabout.

Since riser 112 needs to accommodate the diameter of manway 106 only in the area of the manway and below, above the manway, the diameter of the riser 112 may be reduced, to conserve material. As illustrated in FIGS. 2 and 3, the riser is of a unitary diameter, however, stepped reductions in diameter can be practiced, and are known in the art.

The connection between the water-tight cap of the riser and the riser itself is best illustrated in FIG. 3. As shown, riser 112 is prepared from vertical walls of fiberglass reinforced plastic 116. The riser terminates at its upward point in horizontal flange 118. Dome 120 extends across the opening of the riser, and rests on gasket 124 which is interposed between flange 118 and dome 120. The gasket is of a suitable elastomeric material, and resilient and resistant to weathering and oxidation. A releasable "C"-clamp 122 encircles the dome and flange. The clamp is of a type generally used to secure the tops of oil barrels and the like, and takes the form of a tensioned "spring", which can be released by operation of a horizontal cam or handle. Other similar clamps will be familiar to those of skill in the art, and are acceptable provided sufficient force is applied to bring the flange and dome edge into abutment sandwiching the gasket therebetween.

In operation, access to the interior of the tank is provided through access way 114, which is opened to reveal dome 120 and clamp 122. Releasing clamp 122 allows the operator to lift dome 120, or otherwise move it out of position. As dome 120 is of a reduced weight owing to its reinforced fiberglass construction, access to manway 106 through riser 112 is provided relatively easily. In the event physical access to the inside of the tank through the manway is intended, the diameter of the riser (interior) must be sufficient to allow service personnel to pass through the riser, through the manway and into the interior of the tank. A minimum diameter of four feet is generally recommended for this type of installation.

Once installed, the water-tight riser will provide additional containment for the manway, the area adjacent the manway, piping and fittings provided in the riser and connecting with the manway. The water-tight riser also provides an additional way of testing for containment. As water and other liquids are excluded from the interior of the riser, either by riser walls 116 and dome 120, or by the manway (fuels passing therethrough) the interior of the riser should remain relatively liquid free. A sensor or alarm 104 which is sensitive either to liquid, or to the level of liquid in the riser, can be provided. Triggering of the alarm is an indication that either the clamp 122 has failed, or that containment in either the riser 112, manway 106 or piping or fittings 108 has been breached and alerts the operator to undertake remedial action promptly, before damage either to the environment or the tank, or interference with operation of the tank, can occur.

Figure 4:
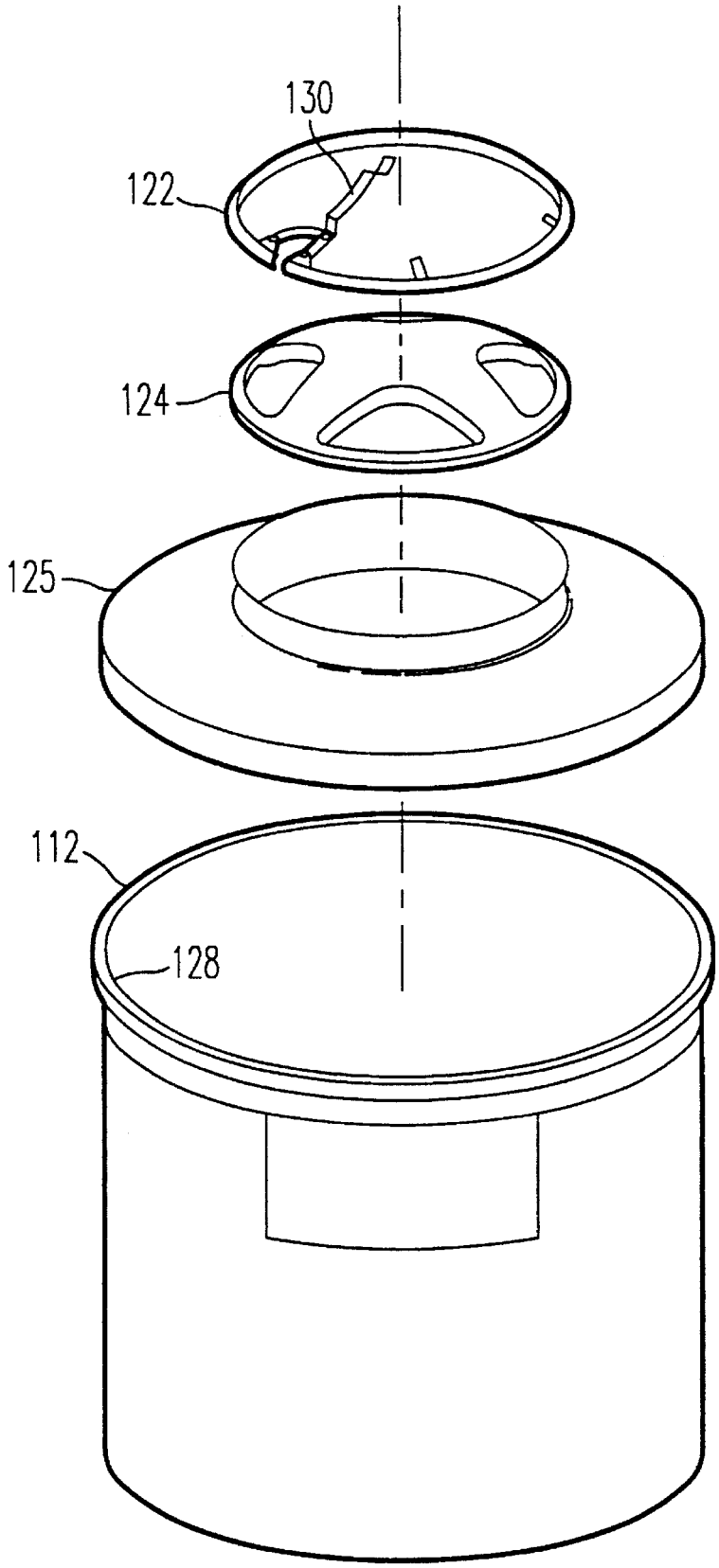
FIG. 4 is an exploded view of a preferred riser, cap and clamp of the invention.

A preferred riser dome or clamp is illustrated in FIG. 4. In this preferred embodiment, riser 112 terminates in a top with a channel 128, in which channel is secured a riser top 126, with an opening therein. The riser top is secured in channel 128, with gasketing as necessary to ensure a water-tight fit. In the narrowed opening of riser top 126, a horizonal flange is provided, on which rests dome-shaped riser cap 124. The cap 124 is secured in water-tight fashion to the flange of top 126 by clamp 122, which is operated by means of the cam 130, which extends substantially horizontally, but may be made to work vertically as well. Clamping between the cap and the top is ensured to be water-tight by use of a gasketing material, which may include conventional rubber materials. In a preferred embodiment, the gasketing material comprises an open-cell foam, which is treated or coated so as to provide an impermeable outer covering. The open-cell foam collapses to a degree greater than conventional gasketing materials, to ensure a tight fit, while the impermeable covering ensures that no liquid penetrates through the collapsed foam. One embodiment employs a tubular gasket of this material.

This invention has been described with reference to specific embodiments, materials, as well as to generic purpose and function. Alternative structures and materials will occur to those of ordinary skill in the art, without the exercise of inventive faculty. Such alternatives remain within the scope of the invention, save as specifically excluded by the claims set forth below.

What is claimed is:

1. In an underground storage tank provided for the containment of liquid materials, said tank being provided with a manway providing access to the interior of said tank, said manway being reached through an access way provided at ground level above said storage tank, wherein the improvement comprises providing a riser about said manway extending from the exterior of said storage tank to a point proximal to and below said access way, said riser being provided with a dome-shaped cover secured in water-tight fashion to said riser.

2. The underground storage tank of claim 1, wherein said cover is secured to said riser by means of a releasable "C"-shaped clamp extending about the circumference of (1) a horizontal flange provided at one end of said riser opposite said tank and (2) said cover which rests on said flange.

3. The underground storage tank of claim 2, wherein a resilient, water-resistant gasket is interposed between said cover and said flange.

4. The underground storage tank of claim 2, wherein said clamp is released by means of a horizontally extending cam.

5. The underground storage tank of claim 1, wherein said tank is a double-walled tank.

6. The underground storage tank of claim 1, wherein said tank, manway, riser and dome-shaped cover are comprised of fiberglass reinforced plastic.

7. The underground storage tank of claim 1, wherein an alarm sensitive to liquid is provided in the interior of said riser.

8. The underground storage tank of claim 1, wherein said dome-shape cover is made out of a thermoplastic resin.

* * * * *